United States Patent [19]

Uno et al.

[11] Patent Number: 4,639,927

[45] Date of Patent: Jan. 27, 1987

[54] CONTINUOUS MELT ELECTRIC FURNACE WITH CONTINUOUS DISCHARGE

[75] Inventors: Kunihiko Uno, Hirakata; Kunihiro Nakazato, Takatsuki; Masahide Nishigaki, Miki; Hajime Hirotomi, Kakogawa; Shigeo Kimura, Kobe; Sadao Kurihara, Kosugimachi; Hideo Tanaka, Takaoka; Jiro Mihara, Tokyo; Kiyoaki Takai, Takaoka, all of Japan

[73] Assignees: Kabushiki Kaisha Takuma, Osaka; Nihon Jukagaku Kogyo Kabushiki Kaisha, Tokyo, both of Japan

[21] Appl. No.: 757,985

[22] Filed: Jul. 23, 1985

[51] Int. Cl.[4] ..... F27D 3/14

[52] U.S. Cl. ..... 373/84; 266/230

[58] Field of Search ..... 432/157, 160; 266/230, 266/231, 229, 240; 373/79, 81, 84, 142, 143, 44

[56] References Cited

U.S. PATENT DOCUMENTS

| | | | |
|---|---|---|---|
| 390,785 | 10/1888 | Koneman | 266/29 |
| 3,626,072 | 12/1971 | Haralampiev et al. | 373/79 |
| 3,706,449 | 12/1972 | Anderson et al. | 266/240 |
| 3,896,257 | 7/1975 | Kinoshita | 373/79 |
| 4,097,032 | 6/1978 | Mauritz | 266/230 |
| 4,181,812 | 1/1980 | Collin | 373/84 |

FOREIGN PATENT DOCUMENTS

| | | | |
|---|---|---|---|
| 66920 | 10/1943 | Norway | 373/143 |

*Primary Examiner*—Roy N. Envall, Jr.
*Attorney, Agent, or Firm*—Griffin, Branigan, & Butler

[57] ABSTRACT

An electric melting furnace is provided with an exit comprising an overflow dam and a downwardly extending unmolten-substances blocking plate placed inwardly of the overflow dam. The exit is positioned on or near an extension of a line connecting the center O of a furnace body and one of the furnace electrodes, the distance L in centimeters between the electrode and the overflow dam being determined by the equation:

$$L = 1.6 \times \frac{1}{K} \times \sqrt{4/3 \times P/\pi}$$

where P is the electric furnace load (w) and K is a constant in the range of 16 to 25. Lighter molten substances are continuously discharged over the dam under the weight of the combustion residue. Heavier molten metals accumulate on the furnace floor and are discharged over dam by tilting the furnace body in the direction of the exit. The furnace has a measuring means placed at an upper interior portion of the furnace for measuring the temperature of the furnace gases and another measuring means placed on the discharge passage for measuring the quantity of the luminous energy radiated by the molten substances. The values obtained by the temperature measuring means and the luminous energy measuring means are compared with respective standard values as set in advance to determine the feeding of the combustion residue. When one or both of the feeding conditions is/are met, a fixed amount of the combustion residue is fed into the furnace by opening a feeding gate.

8 Claims, 3 Drawing Figures

CONTINUOUS MELT ELECTRIC FURNACE WITH CONTINUOUS DISCHARGE

BACKGROUND OF THE INVENTION

The present invention relates to an electric melting furnace which can continuously melt the combustion residue such as ashes collected by dust collectors and the like and resulting from the burning of city refuse, sewage sludge and industrial wastes.

In general, most of the city refuse combustion residue, that is the ashes collected by the dust collectors and the like, are dumped. However, dumping places are getting scarce hence it is desirable that the volume of the city refuse combustion residue be decreased as much as possible.

Melting furnaces using oil burners have been developed to decrease the volume of the city refuse combustion residue but the furnaces now in use have various technical problems and therefore cannot be operated smoothly. For instance, in conventional furnaces, clinkers grow at the place where ashes are discharged, thereby making it difficult to continuously discharge the molten ashes. Further, it is not easy to continuously and completely melt the combustion residue, thus making the reduction in volume of the combustion residue difficult.

The present invention, in an attempt to solve the problems of the conventional melting furnaces which use oil burners or the like, uses an electric melting furnace for melting the combustion residue.

The electric melting furnace is widely used in the steel industry and other fields and is a technically stable apparatus, but operation of the conventional electric melting furnace requires experience and skill. When used in a plant in which the combustion residue is treated, many problems arise as follows.

Firstly, in order to discharge molten substances, the conventional electric melting furnace is either provided with a tapping opening on the furnace side wall which is intermittently unplugged to discharge the molten substances, or the declining method of discharge is used in which the whole structure of the electric melting furnace is tilted to discharge the molten substances from an exit positioned at the upper portion of the furnace.

The former method, i.e., the tap method, necessitates periodic unplugging of the tapping opening, and plugging again after discharging the molten substances. The operation of unplugging and plugging requires experience and skill and can be dangerous unless caution is exercised because the operation is usually conducted in a bad operational environment.

On the other hand, the latter method, i.e., the declining method has problems of poor thermal and melting efficiencies because the method necessitates interrupting the supply of electricity, lifting electrodes in the furnace and interrupting the feeding of the combustion residue while tilting the furnace.

Secondly, the conventional electric melting furnace has a problem in that molten metal sediments collect on the bottom floor of the furnace when the combustion residue, such as the refuse combustion ashes, contains plenty of metals. That is, the metals settle to the bottom floor since the specific gravity of the metals is greater than that of the molten slag (molten ashes). Since the depth of the total molten layer is generally fixed, the molten metal layer deepens (i.e. thickens) over a long period of operation while the molten slag layer shallows (i.e. thins). Since the lower end of the electrode is dipped and submerged in the molten slag layer, the lower end of the electrode is increasingly less submerged as the molten metal layer thickens, with the result that the load is lowered, thereby gradually reducing the melting capacity In order to avoid the gradual deterioration in melting capacity, and thus to efficiently maintain the molten state, it is necessary to periodically discharge the molten metal in order to maintain the depth of the molten slag layer above a fixed value so that the depth of submersion of the electrodes is kept at a level providing the most desirable molten state. One of the methods for discharging the molten metals is to unplug a tap hole provided on the bottom of the furnace floor, but as stated above, this method requires experience and skill and can be dangerous if caution is not exercised.

The other method for discharging the molten metals is the declining method adopted with the conventional electric melting furnace, and, while the unplugging of the tapping hole is not necessary, the furnace body must be either tilted after lifting the electrodes out of the interior of the furnace body or tilted together with the electrodes placed in the furnace body. In the former case, electric loading is necessarily stopped while the electrodes are being lifted. Further, if the furnace has a furnace lid, the electrodes need be lifted well above the furnace lid with the result that the electrodes lifting distance increases, thereby making the electrode equipment large in size. On the other hand, in the latter case the whole furnace structure, including the electrode equipment, must be declined with the result that the declining apparatus must be large in size.

Thirdly, a problem relating to feeding of materials such as the combustion residue should be considered. The conventional electric melting furnaces adopt a batch method in which, after a fixed amount of materials is fed, the furnace discharges the whole molten substances, and then the furnace is refilled with a new supply of materials. But, the batch method has a limit to the melting efficiency and is not appropriate for the melting of combustion residue. That is, in order to achieve a stable and continuous melting and a continuous discharge of the molten substances for improving the melting efficiency, it is necessary to continuously and efficiently feed the furnace with the materials (combustion residue) and further to feed the materials evenly between the electrodes for obtaining the highest melting capacity at a speed which matches the melting speed.

SUMMARY OF THE INVENTION

The present invention seeks to solve the problems which arise when a conventional electric melting furnace is utilized to melt a combustion residue.

It is a first objective of the invention to provide an electric melting furnace wherein the operation of discharging the molten substances does not require special skill, experience or caution, the discharging operation permitting a continuous melting operation and continuous discharge of the molten substances, with the result that the present invention is easy to operate and hence does not need operators with special skills, has a high combustion-residue melting efficiency and is compact in size and hence makes possible a substantial reduction in equipment and operation costs.

It is a second objective of the present invention to provide an electric melting furnace which is structured so that it may be tilted, thus being capable of discharging molten metals with certainty without lifting the electrodes out of the interior of the furnace body, thereby making highly efficient melting of the combustion residue possible.

It is a third objective of the present invention to provide an electric melting furnace which can be fed with combustion residue evenly inside the furnace body at a speed matching the melting speed of the combustion residue in the furnace, thereby achieving a high melting efficiency and enabling the stable and continuous melting and the continuous discharging of the molten substances.

In order to achieve the above stated objectives, the present invention is structured as follows. The furnace body of the electric furnace is provided with an exit on the side wall thereof for discharging the molten substances, the exit comprising an overflow dam of proper height and a flow blocking plate which is positioned inwardly of the dam and which hangs from the upper portion of the interior of the furnace to thereby block outflow of the unmolten substances. The exit is positioned on or near an extension of a line which extends through one of the electrodes in the furnace body and the center of the furnace body. The distance between the above-stated electrode and the dam is determined by the equation:

$$L = 1.6 \times \frac{1}{K} \times \sqrt{\frac{4}{3} \times \frac{P}{\pi}},$$

where: P is the electric furnace load that is, the power in Watts supplied to the furnace; K=a constant in the range of 16–25 ($\text{watt}^{\frac{1}{2}} \cdot \text{cm}^{-1}$) and L is in centimeters. The furnace body is mounted on a declining apparatus so that the furnace body can be tilted in the direction of the exit.

A heat-resisting accordion-like tube is provided between the furnace body and the furnace lid so that the furnace body may be tilted without moving the lid which carries the electrodes. Further, a temperature measuring means is provided at the upper portion of the furnace interior for measuring the temperature of the furnace gases and a luminous energy quantity measuring means is provided on the discharge passage to measure the luminous energy of the molten substances passing therethrough so that the respective values obtained by the temperature measuring means and the luminous energy quantity measuring means may be compared with respective predetermined standard values. Signals developed from the comparison control one or more feed gates to control the feeding of a fixed amount of the combustion residue into the furnace when the value gained by the temperature measuring means and/or the value obtained by the luminous energy quantity measuring means meets the conditions for feeding the combustion residue.

DETAILED DESCRIPTION OF THE INVENTION

Figure 1:
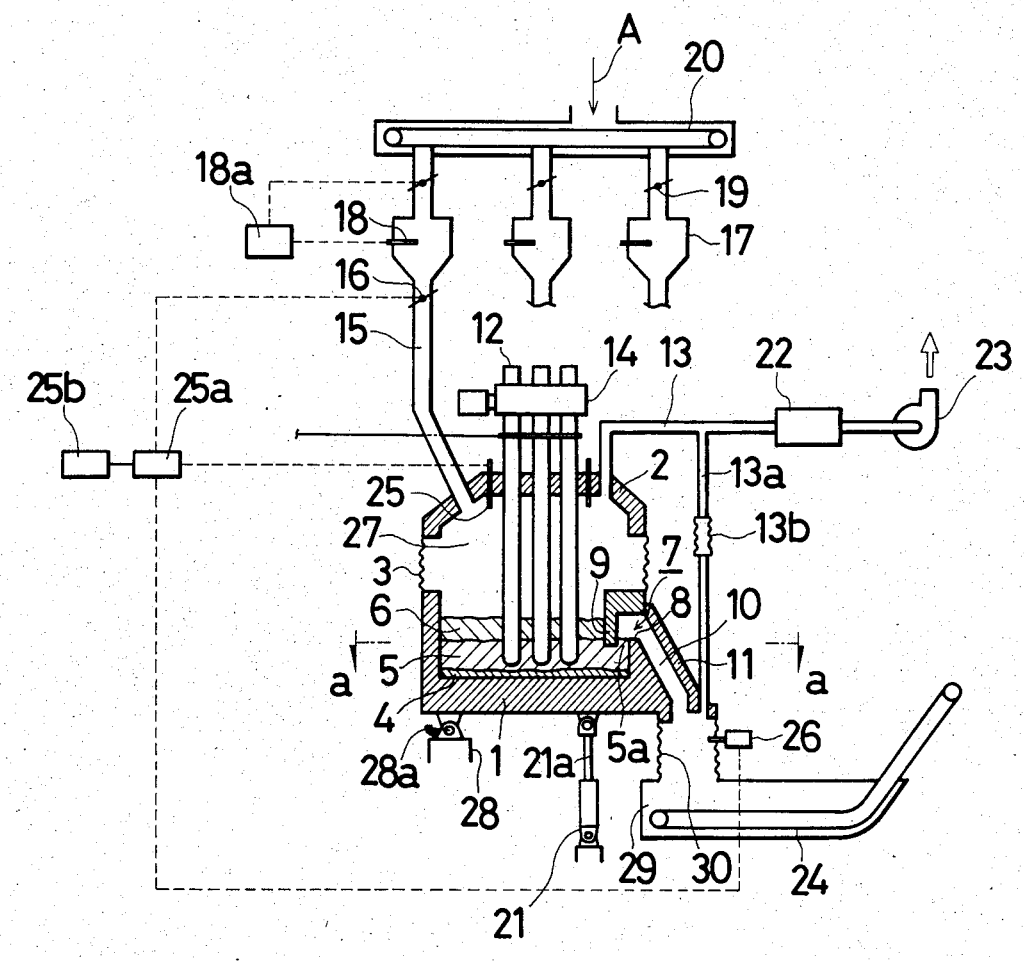
FIG. 1 is a front elevation, partly in section, illustrating an embodiment of the present invention.
Figure 2:
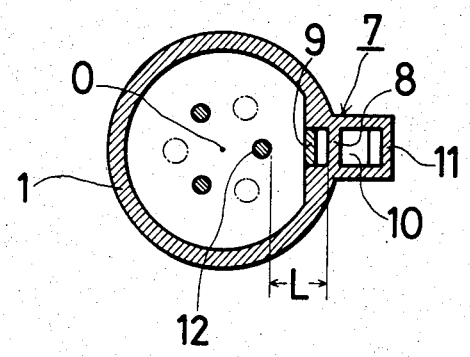
FIG. 2 is a sectional view taken along the line a—a of FIG. 1.
Figure 3:
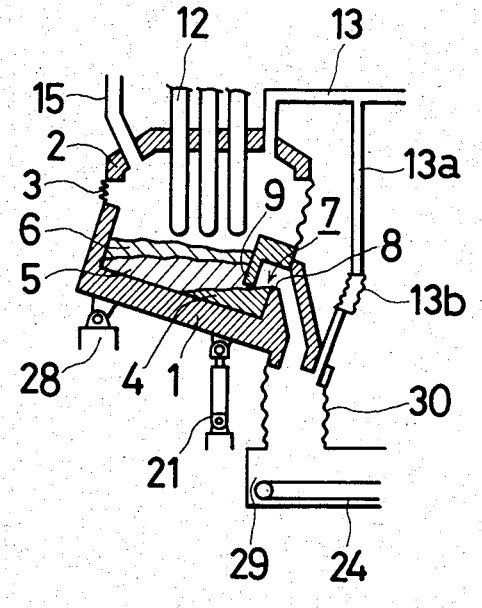
FIG. 3 is a front elevation, partly in section, depicting the furnace body in a declined or tilted state.

Referring now to FIGS. 1 to 3, a preferred embodiment of an electric furnace constructed in accordance with the principles of the present invention includes a furnace body 1, a furnace lid 2, and a heat-resisting accordion-like tube 3 which forms an air-tight seal between the furnace body 1 and the lid 2. FIG. 1 illustrates molten metals 4 deposited on the furnace bottom, molten ashes (molten slag) 5, and unmolten substances 6. A discharge exit 7 is provided on the side wall of the furnace body and includes an overflow dam 8 provided at the lower portion of the side wall of the furnace body 1 and an outflow blocking plate 9 hanging from the upper portion of the furnace body 1 and positioned inwardly of the dam 8. A discharge passage 10 is provided below the dam 8, the passage being defined in part by a passage cover 11 made of heat insulating material. The discharged passage directs molten slag to a slag pit 29 and a conveyor 24 may be provided for conveying slag from the pit.

A plurality of furnace electrodes 12 extend through, and are supported by the lid 2, an electrode elevating apparatus 14 being provided for vertically positioning the electrodes. A dust collecting duct 13 and one or more combustion residue feed chutes 15 terminate at openings in the lid 2. Combustion residue hoppers 17 are provided with a level indicator 18 and a hopper entrance gate 19. A combustion residue distributing conveyor 20 distributes combustion residue, represented by arrow A, to the hoppers.

As shown in FIG. 2, discharge exit 7 is positioned on or near an extension of a line connecting one of the electrodes 12 and the center O of the furnace. The height of the overflow dam 8 is so determined that the combustion residue A can be molten at the highest efficiency in accordance with the capacity of the electric melting furnace. The blocking plate 9 which blocks the overflow of the unmolten substances 6 is placed at a substantially right angle relative to an extension of a line connecting one of the electrodes 12 and the center O of the furnace. The lower edge of the blocking plate 9 is positioned lower than the top edge of the dam 8 and hence dips somewhat into the molten substances 5, thereby blocking outflow of the unmolten substances 6 so that the molten substances 5 alone may be allowed to flow over the dam 8 and down the discharge passage 10.

The dam 8 must be positioned so that the molten substances 5 are always kept at a temperature which allows the molten substances 5 to easily overflow the dam. The distance L between the electrode 12 and the dam 8 is determined on the basis of the flow characteristics of the molten substances 5 derived from the combustion residue A, these flow characteristics being derived from the results of various experiments. That is, according to the conventional electric melting furnace, the diameter of the electrodes, the distance between the electrodes, dimensions (for instance, the bottom floor area) of the furnace and the loading conditions (such as an electric current, voltage, power density and so on) are determined in accordance with characteristics of the molten substances 5. However, when the combustion residue A is, for instance, combustion ashes, the basicity $CaO/SiO_2$ is as low as 0.3–0.4 with the result that the fluidity of the molten substances 5 is very poor. Consequently, in order to achieve a good fluidity, the temperature of the molten substances 5 need always be kept at 1500° C.–1700° C.

In order to keep the molten substances at 1500° C.–1700° C. and for the molten substances 5 to continuously overflow the dam 8 at a capacity of 10–60 ton/day, the overflow opening 5*a* must be positioned within the molten zone formed by energy provided by the electrodes 12 so that the fluidity may always be good at the overflow dam 8. To achieve this, the distance L from the outer surface of the overflow dam 8 to the outer surface of the electrode 12 closest to the overflow dam 8 must be determined by the equation:

$$L = 1.6 \times \frac{1}{K} \times \sqrt{\frac{4}{3} \times \frac{P}{\pi}}$$

where P is the electric furnace load or power, expressed in Watts, supplied to the furnace, K is a constant in the range of 16 to 25 (watt$^{\frac{1}{2}}$·cm, and L is in centimeters. If the distance L is determined as above, it can be shown that the overflow opening 5*a* is always positioned within the above mentioned molten zone, thereby achieving a good fluidity. The equation as given above was obtained on the basis of the results of many melting experiments.

The furnace body 1 is mounted on a support 28 and a declining apparatus 21 so that the exit side of the furnace body 1 can be moved up and down by operating a piston 21*a*, with a pivot 28*a* on support 28 functioning as a fulcrum. An accordion-like flexible tube 13*b* is provided on a branch duct 13*a* and a further accordion-like flexible tube 30 is provided to link the lower end of the discharge passage 10 and the upper end of the slag pit 29 in an air-tight manner, thereby facilitating the tilting movement of the furnace body 1 from the position shown in FIG. 1 to that shown in FIG. 3.

On the other hand, the electrodes 12 are mounted for vertical sliding movement through lid 2. The feed chute 15 and a dust collecting duct 13 are immovable parts connecting with he interior of the furnace through lid 2.

A temperature measuring means 25 is mounted on the lid 2 to measure the temperature of gases inside the electric melting furnace and a luminous energy quantity measuring means 26 is placed above the slag pit 29. The temperature measuring means 25 and the luminous energy quantity measuring means 26 are provided to regulate feeding of the combustion residue A. A feed regulating means comprises the temperature measuring means 25, the luminous energy quantity measuring means 26, a feed regulating apparatus 25*a* which is activated by signals transmitted from the temperature measuring means 25 and the luminous energy quantity measuring means 26, and a temperature setting means 25*b*.

When the combustion residue A is fed into the electric melting furnace, the temperature of the furnace gases in region 27 temporarily drops. Thereafter, as melting of the combustion residue A progresses and, accordingly, the unmolten substances 6 diminish, the temperature of the furnace gases 27 rises in accordance with the diminishing of the unmolten substances 6.

It is noted that there exists a close correlation between rise of the temperature of the furnace gases 27 and the amount of the unmolten substances 6. Since an increase of the furnace gas temprature as taken by the temperature measuring means 25 is interpreted to mean a decrease in the amount of the unmolten substances 6, the rise of the temperature indicates the progress of melting in the furnace, thereby providing an indication as to when to feed more refuse combustion residue A.

The amount of the molten substances 5 being discharged out of the exit 7 increases when a new supply of the combustion residue A is fed because the molten substances 5 are pressed downward under the weight of the unmolten substances 6, thereby increasing the amount of the molten substances 5 which overflow the dam 8. Hence, as the unmolten substances 6 are decreased, the discharged molten substances 6 are gradually decreased. This shows that there exists a close correlation between the amount of the unmolten substances 6 and the amount of the molten substances 5 as discharged. The measurement of change of the amount of the molten substances 5 as discharged leads to the knowledge of change of the unmolten substances 6. That is, a change in the quantity of the luminous energy radiated by the molten substances 5 as discharged is detected and measured by the luminous energy quantity measuring means 26 using a photo-electric conversion element or an industrial TV set. A decrease in the luminous energy quantity as measured indicates a decrease in the discharged molten substances 5 and this is interpreted to indicate a decrease in the unmolten substances 6 in the furnace, thereby indicating when to feed a new supply of the refuse combustion residue A.

The embodiment shown in FIG. 1 is so structured that the feeding of the combustion residue A into the furnace is controlled by both the temperature of the furnace gases 27 and the quantity of the luminous energy radiated by the molten substances 5 as discharged, wherein the combustion residue A is fed when the temperature and the luminous energy quantity both come to equal predetermined values which allow the feeding of the combustion residue A.

That is, a value representing the temperature of the furnace gases 27 which is tantamount to the critical ceiling value is fed into the setting means 25*b*. A signal transmitted from the setting means 25*b* and the output signal transmitted from the temperature measuring means 25 are compared at the feed controlling means 25*a* to determine whether the output from the temperature measuring means 25 exceeds the output from the setting means 25*b*. In the same manner, the output signal from the luminous energy quantity measuring means 26 is fed into the feed controlling means 25*a*. The signal from means 26 is compared to a signal representing some standard value determined according to the minimum discharge amount of the molten substances 5 for determining whether or not the feeding condition is met. When the feeding condition on the part of the temperature measuring means 25 and the feeding condition on the part of the luminous energy quantity measuring means 26 are both satisfied, the feed controlling means 25*a* gives a signal instructing the feed gate 16 to open for a fixed length of time so that a predetermined amount of the combustion residue A is fed into the furnace.

The furnace of FIG. 1 operates as follows. The combustion residue A is carried by the distributing conveyor 20 and deposited in the hoppers 17 for subsequent feeding into the electric melting furnace through plural feed chutes 15 mounted on the lid 2. Each hopper 17 has a level indicator 18 which controls a hopper entrance gate 19 so that a predetermined quantity of combustion residue is loaded into the hoppers. When feeding the combustion residue A, a feed gate 16 is opened by a signal from the feed controlling means 25*a* and feeds into the furnace all the combustion residue A as deposited in a hopper. A feed gate 16 is opened when the feeding conditions relating to both the temperature measuring means 25 and the luminous energy quantity measuring means 26 are met, as stated above.

The combustion residue, as fed evenly between the electrodes 12 through the chutes 15, is gradually melted in the furnace with the result that layers of molten metals 4 are formed on the furnace floor, the molten substances 5 layered above the molten metals, and the unmolten substances 6 are supported by the molten substances 5.

When the depth (i.e. thickness) of the layer of molten substances 5 exceeds a certain value, the molten substances 5 flow under the blocking plate 9 due to the weight of the unmolten substances 6. After passing under the blocking plate 9 which is slightly dipped in the molten substance 5, the molten substances overflow the dam 8 and, due to the weight of the unmolten substances 6, are pushed upwardly out of the overflow opening 5*a* so as to flow down discharge passage 10. Consequently, the molten substances 5 actually overflow the dam 8 in direct proportion to the amount of combustion residue A fed into the furnace.

If the feeding of the combustion residue A is stopped, the overflowing of the molten substances 6 decreases and finally comes to a complete stop. However, since the overflow opening 5*a* is positioned within the molten zone formed by the electrode 12 located closest to the overflow opening 5*a*, the molten substances 5 near the dam 8 reamin molten. Consequently, when feeding of the combustion residue A is resumed, the molten substances 5 immediately start to overflow the dam 8 again. Blocking plate 9 is provided forwardly of the overflow opening 5*a*, so that the unmolten substances 6 can never overflow the dam 8 together with the molten substances 5.

The heat insulating passage cover 11 is provided over both the dam 8 and the discharge passage 10 so that cooling and, as a result, solidifying (hardening) of the molten substances 5 flowing down the discharge passage 10 may be prevented.

The furnace gases 27 and gases generated in the overflow opening 5*a* and the slag pit 29 are sucked through the dust-collecting duct 13 and the branch duct 13*a*, respectively, and are led to a dust-collecting apparatus 22. After the dust is removed by the apparatus 22, the gases are exhausted by a fan 23.

An experiment relating to melting of the combustion residue (dry ashes) generated in an incineration furnace was conducted with use of an electric melting furnace (capacity: 500 KVA). Conditions adopted in connection with the experiment were:

electric furnace load: 300,000 W,
the diameter of the electrode: 20.3 cm, and,
the distance between the surface of the electrode and the front wall surface of the dam was 28 cm.

As a result of the experiment, the electric power consumption for treating of one ton of the combustion residue A was 560–850 KWH. Further, at a melting capacity of 10t/day, a highly stable and continuous melting and discharging of the molten substances 5 was realized.

If the combustion residue A contains a substantial amount of metals, molten metals 4 are deposited on the furnace floor with the passage of time and, hence, must be discharged. When discharging the molten metals 4, the electrodes 12 are lifted to such an altitude that the electrodes 12 do not touch the layer of the molten metals 4 and then the furnace body 1 is tilted by operating the declining apparatus 21 with the pivot 28*a* functioning as the fulcrum, as shown in FIG. 3, thereby discharging the molten metals 4 through the overflow opening 5*a* to the outside of the furnace.

At an early stage of the tilting of the furnace body 1, both the molten substances 5 and the molten metals 4 pass under the blocking plate 9, but after a little while, the discharge of the molten substances 5 is blocked by the blocking plate 9 with the result that the molten metals 4 alone are allowed to discharge. If the furnace body 1 is returned to its original position at the time nearly all the molten metals 4 have been discharged, it is possible to resume the melting of the combustion residue A with the same load as prior to the discharge of the molten metals since the depth of the molten substances 5 has not changed.

Since the space between the furnace body 1 and the lid 2 is filled with the heat insulating accordion-like tube 3 and the furnace gases 27 are sucked through the dust-collecting duct 13, gases and dust do not find their way to the outside of the furnace and heat radiation is not increased.

The feeding of the combustion residue A is controlled in the manner as stated above. That is, the temperature corresponding to the critical ceiling value of the furnace gas temperature is determined and fed into the temperature setting means 25*b*. The signal value of the luminous energy quantity corresponding to the critical value of the outflowing quantity of the molten substances 5 is also determined and fed into the feed controlling means 25*a*. The output signal from the temperature measuring means 25 and the output signal from the luminous energy quantity measuring means 26 are compared with the respective input standard values. When both of the combustion residue feeding conditions are satisfied, the feed controlling means 25*a* gives a signal instructing the feed gate 16 to open its gate for a fixed length of time for feeding the combustion residue A. When the combustion residue A is supplied, under the weight of the newly supplied combustion residue A the overflowing molten substances 5 are increased.

In the illustrated embodiment, the combustion residue A is supplied when the feeding conditions on the part of both the temperature controlling means 25 and the luminous energy quantity measuring means 26 are both satisfied. However, it is also possible to utilize another feeding method wherein the feeding is started when the feeding condition on the part of either the temperature measuring means 25 or the luminous energy quantity measuring means 26 is satisfied.

The present invention as structured above has several advantages over conventional melting furnaces. First, the continuous and smooth discharge of the molten substances 5 is possible since the present invention includes the exit 7 comprising the overflow dam 8 and the outflow blocking plate 9, and the location of the exit 7 and the distance L between the electrode 12 and the overflow dam 8 are both regulated, with the result that the continuous feeding of the combustion residue A is realized and high melting efficiency is achieved. Secondly, the present invention does not require the dangerous tap-unplugging operation utilized in the prior art hence experienced and skilled technicians are not necessary. Thirdly, no matter whether adopting a natural cooling method or a water cooling method for cooling and hardening (solidifying) the discharged molten substances 5, since a fixed amount of the molten substances 5 is discharged, the present invention has the advantage that the apparatus for cooling and hardening the molten substances 5 need not be big in size, and the cost for producing the cooling and hardening apparatus is lowered. Fourthly, since the furnace body 1 and the lid 2 are linked by the heat resisting accordion-like tube 3, the furnace body 1 alone can be declined by the declining apparatus 21 while the other parts of the electric melting furnace remain fixed, with the result that the molten metals 4 alone can be discharged easily with the blocking plate 9 stoping the outflow of the molten substances 5.

In addition to the fact that the declining apparatus is simple in structure and can be produced at a low cost, the present invention is advantageous in that when the furnace body 1 is returned, after declining, to its original level state, the depth of the molten substances 5 remains almost the same as that prior to the declining of the furnace body 1 with the result that the furnace can be operated at nearly the same load as prior to the declining and, hence, provides high melting efficiency. The declining operation can be remote-controlled with ease and safety, and does not need experienced technicians.

Finally, the present invention seeks to detect the state of the unmolten substances 6 by measuring the temprature of the furnace gases 27, and further detect the amount of the unmolten substances 6 and the outflow amount of the molten substances 5 by measuring the luminous energy quantity so that a new supply of the combustion residue A may be fed when the conditions for feeding the combustion residue A are found satisfied after comparing the output signals relating to both the furnace gas temperature and the luminous energy quantity with the respective predetermined values. As a result, the combustion residue A can be fed efficiently and continuously into the furnace in accordance with the molten state inside the furnace and the outflowing state of the molten substances, thereby stabilizing the melting and discharge of the molten substances with a resultant substantial improvement in all-round treatment efficiency.

The embodiments of the invention in which an exclusive property or privilege is claimed are defined as follows:

1. An electric melting furnace for receiving unmolten combustion residue, continuously melting said combustion residue to produce molten substances, and continuously discharging said molten substances, said furnace comprising:

a furnace body having an exit on a sidewall thereof through which said molten substances are discharged and a plurality of electrodes extending downwardly into said furnace body, said exit comprising an upwardly extending overflow dam and a downwardly extending blocking plate located inwardly of said overflow dam, said blocking plate blocking the outflow of unmolten combustion residue from said furnace;

said exit being positioned substantially colinearly with the center of said furnace body and one of said electrodes, said dam being spaced from said one electrode by a distance L where $$L = 1.6 \times \frac{1}{K} \sqrt{\frac{4}{3} \times \frac{P}{\pi}}$$

where L is expressed in centimeters, P is the electric furnace load in Watts and K is a constant in the range of 16 to 25 $\text{Watt}^{\frac{1}{2}} \cdot \text{cm}^{-1}$.

2. An electric melting furnace as claimed in claim 1 and further comprising:

a declining apparatus for supporting said furnace body and selectively tilting it in the direction of said exit.

3. An electric melting furnace as claimed in claim 2 and further including a lid for closing the top of said furnace and supporting said electrodes, and a heat insulating flexible tube connecting said lid to said furnace body whereby said furnace body may be tilted while said lid remains stationary.

4. An electric melting furnace as claimed in claim 3 and further comprising:

a discharge passage connecting with said exit whereby said molten substances are continuously discharged through said discharge passage.

5. An electric melting furnace as claimed in claim 4 and further comprising:

temperature measuring means for measuring the temperature of furnace gases in an upper region of said furnace and producing a first output;

luminous energy measuring means for sensing luminous energy radiated by molten substances discharged through said discharge passage, said luminous energy measuring means producing a second output;

means for establishing standard values representing the furnace gas temperature and luminous energy conditions at which additional combustion residue should be fed into said furnace;

feed means for feeding a fixed amount of combustion residue into said furnace; and means responsive to said temperature measuring means, said luminous energy measuring means, and said means for establishing standard values for actuating said feed means when said outputs are equal to said standard values.

6. An electric melting furnace as claimed in claim 5 wherein said last-named means actuates said feed means when either of said outputs is equal to its respective standard value.

7. An electric melting furnace as claimed in claim 1 wherein said combustion residue includes metals which, when melted in said furnace, settle to the bottom thereof, said furnace further including:

declining means for tilting said furnace body in the direction of said exit to discharge said melted metal from said furnace over said dam.

8. An electric melting furnace as claimed in claim 7 wherein said dam has an upper edge extending above the lowermost extent of said electrodes and said blocking plate has a lower edge which is lower than the upper edge of said dam.

* * * * *